US005329648A

United States Patent [19]

Davey

[11] Patent Number: 5,329,648

[45] Date of Patent: Jul. 19, 1994

[54] DIVERTER VALVE MANIPULATOR TOOL

[76] Inventor: Wayne C. Davey, 4493 Rainbow Vista Dr., Fallbrook, Calif. 92028

[21] Appl. No.: 87,909

[22] Filed: Jul. 9, 1993

[51] Int. Cl.[5] ..... E04H 4/16; E04H 4/12

[52] U.S. Cl. ..... 4/490; 4/496; 4/512; 81/176.15; 210/416.2; 251/293

[58] Field of Search ..... 4/490, 494, 496, 507, 4/510, 512; 81/125, 176.1, 176.15, 176.2; 210/117, 169, 416.2; 251/292, 293

[56] References Cited

U.S. PATENT DOCUMENTS

| | | | |
|---|---|---|---|
| 1,397,876 | 11/1921 | Meldal | 81/176.15 X |
| 1,807,625 | 6/1931 | Hjorth | 251/293 X |
| 3,822,616 | 7/1974 | Phillips | 81/176.15 |
| 4,461,703 | 7/1984 | Vetter | 4/490 X |
| 4,737,279 | 4/1988 | Lewis | 4/490 X |
| 4,740,307 | 4/1988 | Buelteman | 4/512 X |
| 4,818,389 | 4/1989 | Tobias et al. | 4/490 X |

*Primary Examiner*—Robert M. Fetsuga

*Attorney, Agent, or Firm*—John T. Matlago

[57] ABSTRACT

A tool comprising an elongated handle on the upper end of a driver member for remotely changing the rotational setting of a diverter valve mounted in the suction outlet of a skimmer for a swimming pool. The diverter valve is provided with an adapter ring having a protrusion on the top surface thereof. The driver member comprises a skirt with an upper hub portion. The skirt is provided with a slot on the bottom edge thereof and openings on the sidewall thereof. The hub portion has the elongated handle extending upwardly therefrom and an axial projection extending downwardly therefrom. While the circulating pump for the pool is running, the axial projection enables the skirt to be readily positioned and seated over the upper end portion of the diverter valve and the openings on the sidewall of the skirt enable the driver member to be removed from the diverter valve by permitting water in the skimmer to flow into the suction outlet thereof to break the suction.

7 Claims, 4 Drawing Sheets

DIVERTER VALVE MANIPULATOR TOOL

This invention relates to tools useful when cleaning swimming pools with a portable vacuum pool cleaner and more particularly to a manipulator tool for remotely adjusting the setting of a diverter valve mounted in the suction outlet of a skimmer for the pool.

BACKGROUND OF THE INVENTION

Swimming pool installations are commonly provided with at least one skimmer adjacent the sidewall of the pool. The skimmer is provided with an inlet for receiving water from the surface of the pool as controlled by a floating weir therein and is provided with a suction outlet on the bottom thereof which is connected to one of the sockets of a tee fitting. It is also common practice to provide a main drain suction outlet on the floor of the swimming pool which is connected by a pipe to the opposite socket of the tee fitting. The branch socket of the tee fitting is connected by a pipe to the inlet of an external pump-filter assembly .located adjacent the decking of the swimming pool.

A diverter valve, which includes a hollow upper cylindrical portion, a hollow middle cylindrical portion, and a lower semicircular wall portion with a bottom diagonal wall extending down from an edge thereof is mounted within the top opening of the suction outlet of the skimmer. When so mounted, a shoulder on the bottom of the upper cylindrical portion of the diverter valve rests on the upper rim of the suction outlet and its lower semicircular wall portion extends down into the interior of the tee fitting such that the bottom diagonal wall thereon is disposed opposite the internal openings of both the upper socket and the lower socket of the tee fitting. The diverter valve is provided for the purpose of regulating the amount of the vacuum of the external pump that is made available at the suction outlet of the skimmer and the suction outlet of the main drain of the pool during the normal filtering of the water in the swimming pool.

When it is desired to vacuum the floor of the swimming pool with a portable vacuum cleaner, the diverter valve in the suction outlet of the skimmer must be rotatably adjusted by the pool technician extending his hand up to his elbow into the water in the skimmer. This adjustment provides for positioning the bottom diagonal wall on the lower semicircular wall portion of the diverter valve to completely close off the internal opening in the lower socket of the tee fitting connected by a pipe to the main drain on the bottom of the pool. This enables all the vacuum of the pump to be made available to the suction outlet of the skimmer. This, of course, requires that the suction outlets of any other skimmers provided for the pool be plugged off. The pool technician then connects the end of a vacuum hose on a portable vacuum cleaner, placed on the floor of the pool, to the upper cylindrical portion of the diverter valve mounted in the suction outlet of the skimmer to receive the full vacuum of the pump. Then, after cleaning the pool with the portable vacuum cleaner, in order to reset the diverter valve so that a portion of the suction of the pump is again made available to the suction outlet of the main drain, it is necessary for the pool technician to again extend his hand up to his elbow into the water in the skimmer.

This need for the pool technician to have to extend his hand up to his elbow into the water in a skimmer each time he adjusts the setting of the diverter valve is a great inconvenience and nuisance and is especially a problem in the winter months when not only is the water in the pool cold but the pool technician has to remove his shirt and/or jacket that is covering his arms to assure that they do not get wet when he extends his hand up to his elbow in the water in the skimmer.

It should now be clear that it would be highly desirable and more convenient if the pool technician were provided with a manipulator tool that would enable him to remotely change the rotational setting of the diverter valve mounted in the suction outlet of the skimmer to regulate the flow of water being drawn from the suction outlets of the main drain and the skimmer without having to submerge his hand up to his elbow into the water in the skimmer.

SUMMARY OF THE INVENTION

A diverter valve manipulator tool for a skimmer of a swimming pool according to the present invention includes a hollow driver member that comprises an upper hollow hub portion with a skirt depending down therefrom. The skirt is provided with vertically extending openings about the cylindrical wall thereof and a rectangular slot on the bottom thereof. An inner guide member for the driver member comprises a circular plate having depending down from the bottom thereof an elongated axial projection provided with radial fins and having on the top thereof a post. The upper rim of the circular plate is seated and secured against an annular shoulder on the underside of the hollow hub portion. When the inner guide member is so joined to the driver member the bottom end of the axial projection thereof extends below the bottom edge of the skirt. An elongated tubular handle has its lower end inserted and secured within the hollow hub portion, and the post on the top of the circular plate of the inner guide member is inserted and secured within the bottom end portion of the tubular handle.

In order to use the diverter valve manipulator tool of the present invention it is necessary to provide a conventional diverter valve with an adapter ring that has a rectangular projection on the top surface thereof. The adapter ring encircles the upper cylindrical portion of the diverter valve and is held above the shoulder thereof.

While the circulating pump for a swimming pool is running, the pool technician, by holding the upper end of the handle which protrudes out of the top opening in the skimmer, positions the bottom end portion of the inner guide member into the water in the skimmer above the top opening of the diverter valve mounted on the suction outlet thereof. This enables the skirt of the driver member when lowered to fit about the outer surface of the upper cylindrical portion of the diverter valve so that the rectangular slot on the bottom edge thereof engages the rectangular projection on the top surface of the adapter ring held on the shoulder thereof. The pool technician then adjusts the rotational setting of the diverter valve by twisting the upper end portion of the handle.

One of the objects of the present invention is to provide a manipulator tool for enabling a pool technician to remotely adjust the setting of a diverter valve mounted within the top opening of the suction outlet of a skimmer, while the circulating pump is running, without the need for the technician having to extend his hand up to his elbow in the water in the skimmer.

Another object of the present invention is to provide a driver member on the end of an elongated handle which comprises a skirt that fits over the upwardly projecting cylindrical portion of a diverter valve mounted on the top of the suction outlet of a skimmer and has a rectangular slot on the bottom thereof that engages a rectangular projection provided on the top surface of a adapter ring that is held on the shoulder provided on the upper cylindrical portion of the diverter valve.

Still another object of the present invention is to provide a skirt of a driver member that is connected on the end of an elongated handle with an inner guide member that assists in the positioning of the skirt in the water of the skimmer so that it can be remotely placed, while the circulating pump for the pool is running, over the upper cylindrical portion of the diverter valve mounted on the top of the suction outlet of a skimmer.

These and other objects, features and advantages of the present invention will be made more readily apparent from the following detailed description of the preferred embodiment as illustrated in the accompanying drawings.

DESCRIPTION OF THE PREFERRED EMBODIMENT

Figure 1:
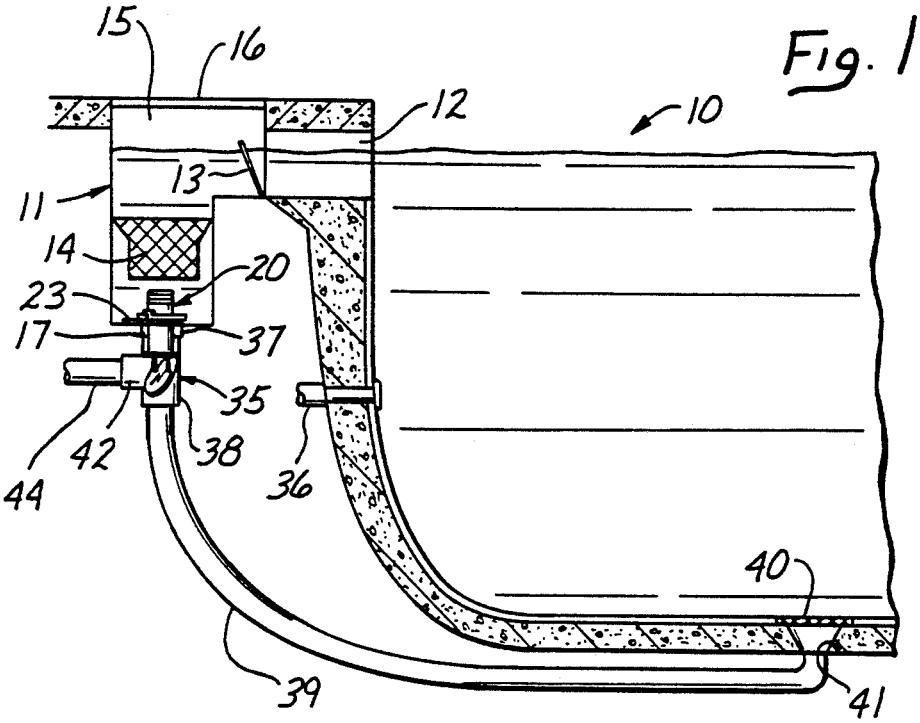
FIG. 1 shows a portion of a typical swimming pool installation provided with a skimmer on the upper sidewall thereof.
Figure 4:
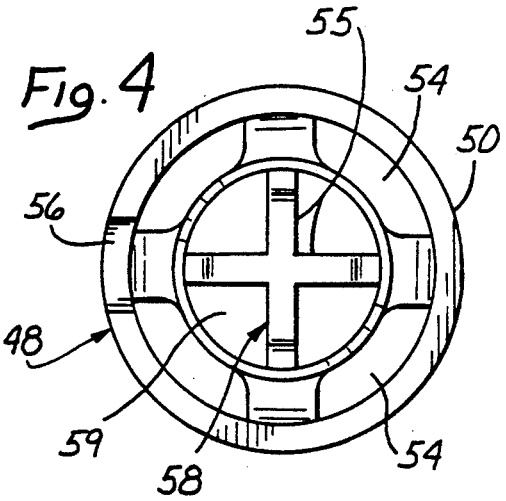
FIG. 4 is a bottom view of the manipulator tool in FIG. 2.
Figure 8:
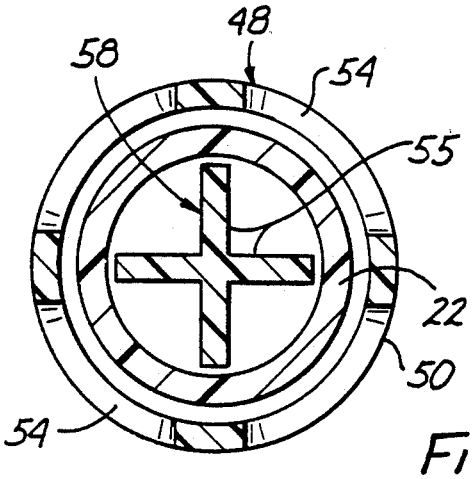
FIG. 8 is a cross sectional view of the driver member positioned over the upper cylindrical portion of the diverter valve as taken along line 8—8 of FIG. 7.

Reference will first be made to FIG. 1 showing a schematic view of a portion of a typical swimming pool installation 10 which is provided with a skimmer 11 adjacent the upper sidewall thereof. The skimmer 11 includes a top opening 15 covered by a lid 16, a skimming inlet 12 with a floating weir 13 therein, and a bottom suction outlet 17. A tee fitting 35 has its upper socket 37 connected within the bottom opening of the suction outlet 17, its lower socket 38 connected by a pipe 39 to the suction outlet 41 of a main drain 40 on the floor of the pool, and its branch socket 42 connected by a pipe 44 to a circulating pump (not shown) located adjacent the decking of the pool. A conventional diverter valve 20 is mounted on the top of the suction outlet 17 of the skimmer 11.

Figure 5:
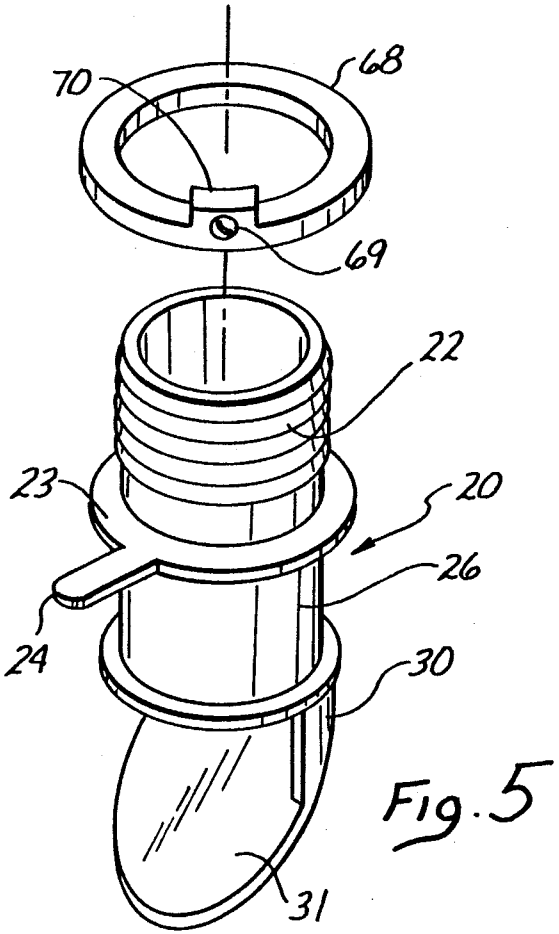
FIG. 5 is a perspective view of a conventional diverter valve with an adapter ring therefor exploded away therefrom.
Figure 3:
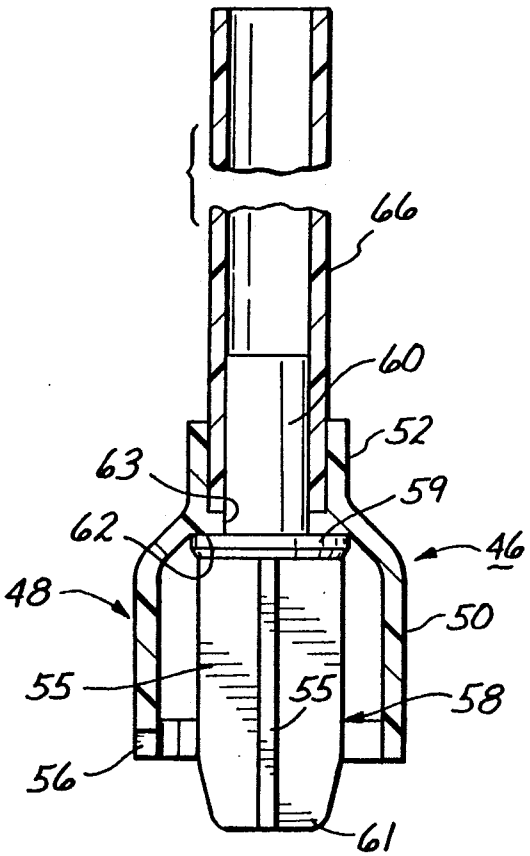
FIG. 3 is a vertical sectional view of the manipulator tool as taken along line 3—3 of FIG. 2.

The diverter valve 20, as best shown in FIG. 5, includes an upper hollow cylindrical portion 22 provided with a shoulder 23 on the bottom thereof, an intermediate hollow cylindrical portion 26, and a lower semicircular wall portion 30 having a diagonally disposed flat bottom wall 31 depending from a bottom edge thereof. When the diverter valve 20 is inserted in the top opening of the suction outlet 17, as best shown in FIG. 6, the shoulder 23 on the bottom of its upper cylindrical portion 22 is seated on the rim of the top opening of the suction outlet 17 with its intermediate cylindrical portion 26 passing through the suction outlet 17 and its lower portion formed of a semicircular wall portion 30 positioned within the interior of the tee fitting 35 with its bottom diagonal wall 31 located opposite the internal openings of both the upper socket 37 and the lower socket 38 of the tee fitting 35.

Figure 6:
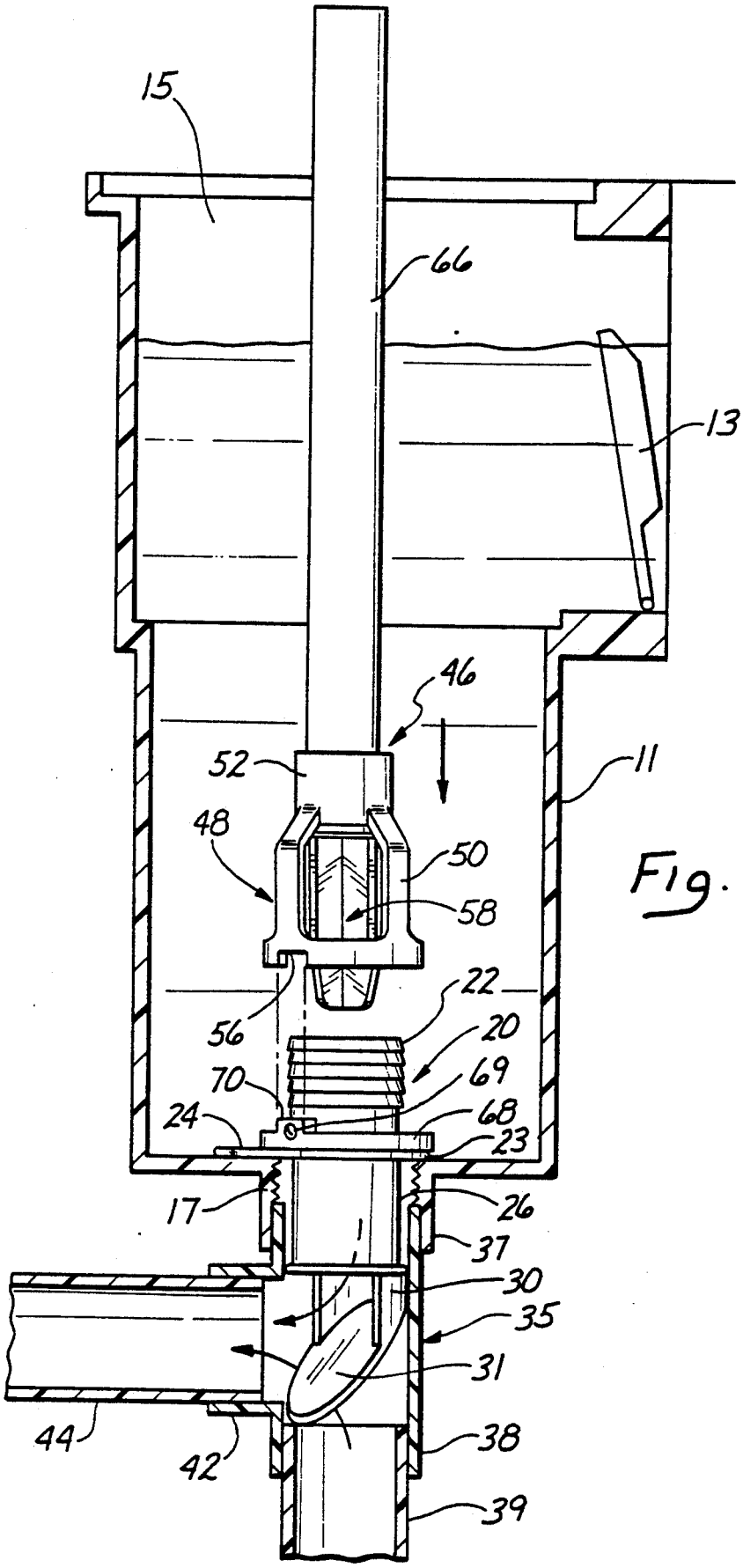
FIG. 6 shows the driver member of the manipulator tool of the present invention being positioned by the use of the elongated handle thereon in the skimmer above the diverter valve mounted in the suction outlet thereof.

During normal filtering of the water in the pool, the diverter valve 20 is set, as shown in FIG. 6, so that its semicircular outer wall 30 and its bottom diagonal wall 31 permit the vacuum of the pump to be made available to draw water from both the skimmer suction outlet 17 and the main drain suction outlet 41. After passing through an external filter, this water is then returned to the pool by inlets, such as inlet 36, (FIG. 1) provided on the sidewall of the pool.

Figure 7:
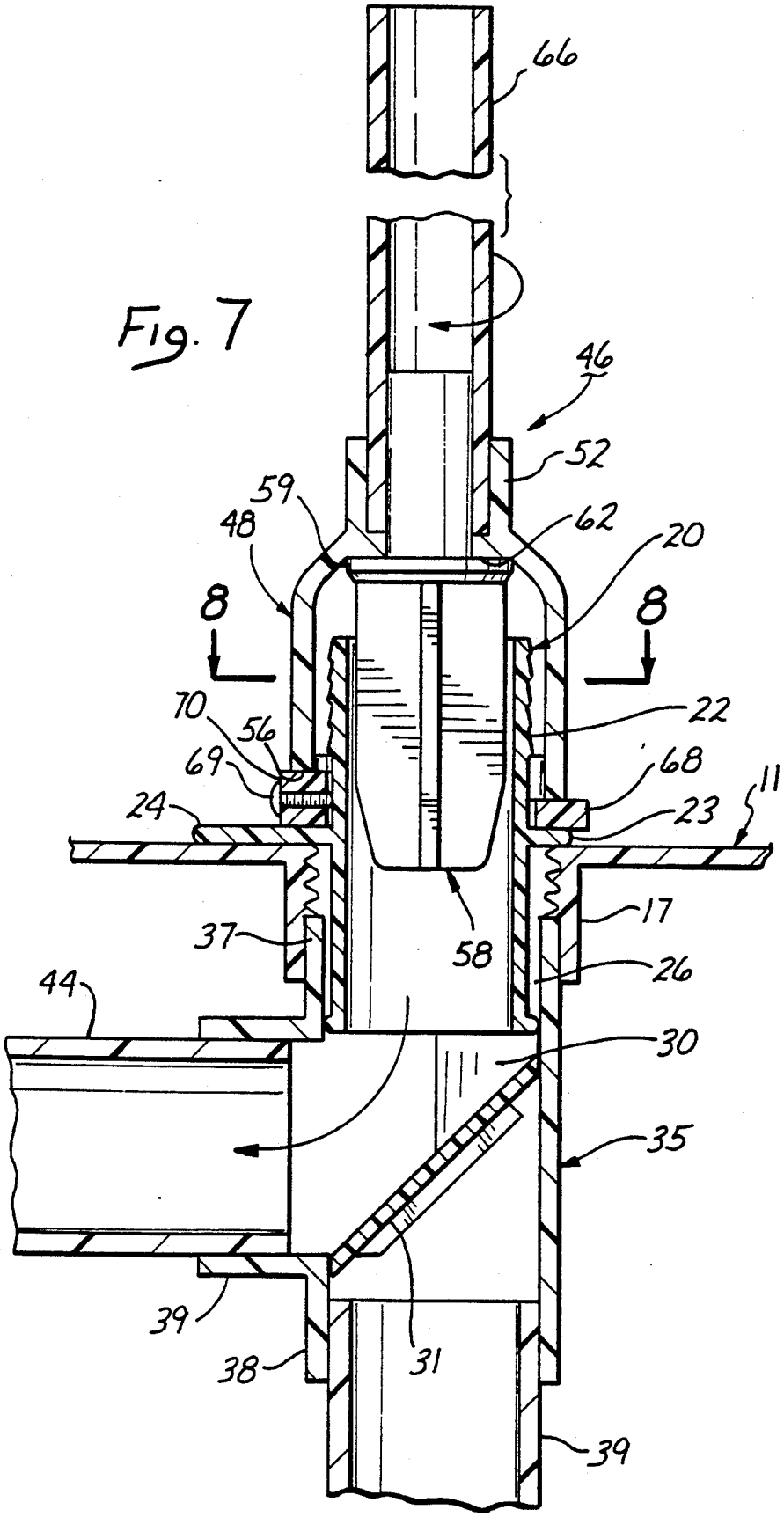
FIG. 7 is a sectional view showing the driver member of the manipulator tool positioned over the cylindrical portion of the diverter valve with the rectangular slot on the bottom of its skirt engaged on the rectangular projection on the top of the adapter ring secured above the shoulder thereof.

When it is desired to vacuum the floor of the swimming pool with a portable vacuum cleaner placed in the pool, it is necessary for the pool technician to reset the diverter valve 20 by rotating it so that all the vacuum supplied by the pump is made available at the suction outlet 17 of the skimmer 11, as shown in FIG. 7. The shoulder 23 on the bottom of the upper cylindrical portion 22 of the diverter valve 20 is provided with a pointer 24 to assist the pool technician in observing the rotational movement thereof.

Figure 2:
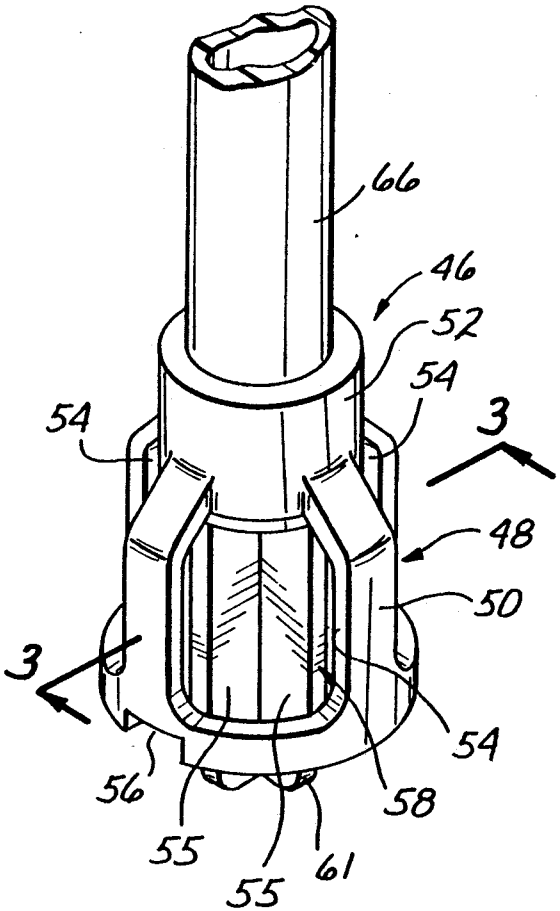
FIG. 2 is a perspective view of the diverter valve manipulator tool of the present invention.

Reference will next be made to FIG. 2 which shows a perspective view of the manipulator tool 46 of the present invention which enables a pool technician to remotely change the setting of the diverter valve 20 mounted in the skimmer suction outlet 17, as needed to enable the portable vacuum cleaner to operate, without requiring that the technician extend his hand up to his elbow in the water of the skimmer. As shown in FIG. 2, the manipulator tool 46 comprises a driver member 48 which includes a cylindrical skirt 50 provided with an upper hollow cylindrical hub portion 52. The skirt 50 is provided with four equally spaced vertical side openings 54 about the cylindrical wall thereof and a rectangular slot 56 on the bottom thereof.

An inner guide member 58 for the driver member 42 is comprised of a horizontally disposed circular plate 59 with a depending elongated axial projection formed of four vertically elongated radially disposed fins 55, each fin being disposed at a right angle with respect to the adjacent fins. A post 60 is provided on the top of the circular plate 59. When the circular plate 59 fits up against the shoulder 62 provided on the bottom of the hollow hub 52 of the driver member 48, the post 60 extends upwardly into the hollow hub 52. An elongated tubular handle 66 has its lower end securely held in the hollow hub 52 of the driver member 48 and the post 60 on the top of the circular plate of the inner guide member 58 is securely held in the bottom end portion of the tubular handle 66. The driver member 48, the inner guide member 58, and the tubular handle 66 of the manipulator tool can each be preferably molded of a plastic material.

In order to enable the conventional diverter valve 20 to be manipulated by the tool 46 of the present invention, an adapter ring 68 is placed over the upper hollow cylindrical portion 22 of the diverter valve 20 and is secured thereon by a set screw 69 so as to rest on the shoulder 23 thereof. It should be noted that the adapter ring 68 is provided with a rectangular projection 70 on the top surface thereof.

As shown in FIG. 6, after lifting the lid 16 off the top opening 15 of the skimmer 11 and removing the leaf basket 14 from the interior of the skimmer 11, the pool technician remotely inserts the driver member 48 in the water in the skimmer 11 above the suction outlet 17. With the pump running, the discharging of the water from the skimmer 11 through the suction outlet 17 thereof by the vacuum of the pump creates a vortex movement of the water within the skimmer 11 above the suction outlet 17.

As shown in FIG. 6, it is because the inner guide member 58 tends to stay in the center of the vortex and the lower tapered end portion thereof is drawn by the discharging water into the interior of the upper hollow cylindrical portion 22 of the diverter valve 20, that the skirt 50 of the driver member 48 can be properly positioned so that its outer cylindrical bottom wall fits over and encircles the outer wall of the upper hollow cylindrical portion 22 of the diverter valve 20 (See FIG. 7). It should be understood that if the guide member 58 is not provided within the skirt 50 of the driver member 48, the skirt 50, and thus the driver member 48, tends to move about in the circular path formed by the vortex in the skimmer and it is almost impossible to position the skirt 50 over the upper hollow cylindrical portion 22 of the diverter valve 20.

Once the lower end portion of the guide member 58 is positioned in the interior of the upper hollow cylindrical portion 22 of the diverter valve, the pool technician rotates and lowers the driver member 48 by use of the elongated handle 66 to enable the rectangular slot 56 on the bottom of the skirt 50 to seat on the rectangular projection 70 on the top surface of the adapter ring 68 held on the top of the shoulder 23 on the cylindrical body of the diverter valve 20.

It should be further noted that if the side openings 54 were not provided on the cylindrical skirt 50 of the driver member 48, once the skirt 50 is positioned over the upper hollow cylindrical portion 22 of the diverter valve 20 mounted in the suction outlet 17 and seated on the adapter ring 68, the water in the skimmer would not be able to flow into the interior of the diverter valve 20 and down into the suction outlet 17. In other words, if the side openings 54 were not provided on the cylindrical skirt 50, the suction outlet 17 would be plugged off by the positioning of the skirt 50 over the upper hollow cylindrical portion 22 of the diverter valve 20. Thus it would be impossible for the pool technician to remove the skirt 50 of the driver member 48 off the upper cylindrical portion 22 of the diverter valve until the pump is turned off or the vacuum produced thereby is otherwise broken. It should now be clearly understood that the side openings 54 on the cylindrical skirt 50 are needed to enable the water in the skimmer to continually flow into the interior of the skirt to the suction outlet 17.

It should be noted that in the course of cleaning a swimming pool there is also a need to make use of the manipulator tool 46 to remotely rotatably adjust the setting of the diverter valve 20 to a setting in which all the vacuum being made available by the pump 24 is supplied to the suction outlet 41 of the main drain 40. This latter adjustment requires that the diverter valve be rotated by the manipulator tool 46 to a setting that is 180 degrees from its setting as shown in FIG. 7. In this setting, the diagonal wall 31 on the bottom of the semicircular wall 30 of the diverter valve 20 is positioned so as to close off the suction outlet 17 of the skimmer and open up the suction outlet 41 of the main drain 40. This enables the pool technician to employ a brush on the end of a pole to sweep the silt on the floor and interior sidewalls of the pool towards the vicinity of the main drain 40 where it is then carried by the water being drawn through the suction outlet 41 of the main drain by the pump 24 so as to pass through the external filter from which the clean water is returned to the pool via the inlets 36 on the sidewalls thereof.

With the present disclosure in view, modification of the invention could become apparent to one skilled in the art. Accordingly, the invention is not limited to the details of the illustrated preferred embodiment but includes all such modifications and variations coming within the scope of the invention as defined in the appended claims.

What is claimed is:

1. A manipulator tool for use in a swimming pool installation wherein a diverter valve having a body including an upper hollow cylindrical portion with a circumferential shoulder on a bottom end portion thereof is mounted in a suction outlet provided in a bottom of a skimmer housing with the shoulder seated on the upper rim of the suction outlet, said manipulator tool comprising:

a combination therewith of an adapter ring adapted to encircle the upper cylindrical portion of the diverter valve and to be secured above the shoulder thereof, said adapter ring having a projection on an upper surface thereof;

a driver member including an upper hollow hub portion and a cylindrical skirt depending downwardly thereof, said skirt having side openings therein and a slot on the bottom thereof;

an inner guide member including an upper end portion extending upwardly into the hollow hub portion of the driver member and a lower elongated axial portion depending downwardly therefrom within the cylindrical skirt; and an elongated tubular handle having one end portion extending down into and secured within the upper hollow hub portion of the driver member and having the upper end portion of the inner guide member secured within the one end thereof;

whereby a user by holding the upper end of the elongated handle can position the cylindrical skirt of the driver member over the upper cylindrical portion of the diverter valve and engage the slot on the bottom thereof on the projection provided on the upper surface of the adapter ring to thereby remotely rotate said diverter valve to a desired setting within the suction outlet of the skimmer by twisting the outer end of the elongated tubular handle.

2. A manipulator tool as defined in claim 1 wherein the slot on the bottom of the skirt is rectangular and the projection on the upper surface of the adapter ring is rectangular.

3. A manipulator tool as defined in claim 1 wherein the user may position the cylindrical skirt of the driver member over the upper cylindrical portion of the diverter valve when a circulating pump for drawing water from the pool is running.

4. A manipulator tool as defined in claim 1 wherein the adapter ring, the driver member, the inner guide member and the elongated tubular handle are each molded of a plastic material.

5. A manipulator tool as defined in claim 1 wherein said lower elongated axial portion of said inner guide member includes four vertically disposed radial fins and wherein each said radial fin is oriented at right angles to its adjacent radial fins.

6. A manipulator tool as defined in claim 1 wherein said inner guide member has a lower end portion that extends below the bottom of the skirt.

7. A manipulator tool for use in a swimming pool installation including:

a skimmer on the side of a pool having a main drain on the bottom floor thereof;

said skimmer having a top opening and a bottom suction outlet;

said main drain having a suction outlet; and a tee fitting having an upper socket fitted within the bottom of the skimmer suction outlet, a lower socket connected by a pipe to the main drain suction outlet, and a branch socket connected by a pipe to a circulating pump;

a diverter valve having a hollow body including an upper cylindrical portion provided with a circumferential bottom shoulder thereon, an intermediate cylindrical portion, and a lower semi-circular wall portion provided with a diagonal bottom wall thereon;

said diverter valve mounted within the skimmer suction outlet with the shoulder on the bottom of the upper cylindrical portion resting on the rim thereof and the lower semi-circular wall portion residing within the interior of the tee fitting such that the diagonal bottom wall thereof resides opposite the lower socket and the branch socket thereof;

said manipulator tool comprising:

a driver member including an upper hollow hub portion having a depending cylindrical skirt portion provided with side openings and a rectangular slot on the bottom thereof;

an inner guide member having an upper end portion extending up into the hollow hub portion of the driver member and having a lower elongated axial portion depending downwardly within the skirt of the driver member such that the bottom thereof extends below the bottom of the skirt;

an elongated handle having one end portion secured to the upper hollow hub portion of the driver member and the upper end portion of the inner guide member; and an adapter ring adapted to encircle the upper cylindrical portion of the diverter valve and secured so as to lie above the shoulder thereof, said adapter ring having a rectangular projection on the top surface thereof;

whereby while the circulating pump is running a pool operator by holding onto the upper end of the elongated handle extending out of the top opening of the skimmer can remotely position the inner guide member such that the lower elongated axial portion thereof is drawn by the water being discharged out of the suction outlet of the skimmer into the interior of the upper cylindrical portion of the upper cylindrical portion of the diverter valve with the skirt thereof encircling over the upper cylindrical portion of the diverter valve so that the bottom rectangular slot thereon engages the rectangular projection on the top of the adapter ring on the shoulder thereof, thereby enabling the pool operator to remotely rotate the diverter valve to a desired setting within the suction outlet by twisting the upper end portion of the elongated handle.

* * * * *